US011428248B2

(12) United States Patent
Leinonen et al.

(10) Patent No.: US 11,428,248 B2
(45) Date of Patent: Aug. 30, 2022

(54) MONITORING DEVICE AND METHOD FOR DETERMINING OPERATING HEALTH OF PRESSURE MEDIUM OPERATED DEVICE

(71) Applicant: HYDROLINE OY, Vuorela (FI)

(72) Inventors: Manu Leinonen, Vuorela (FI); Harri Paltemaa, Vuorela (FI)

(73) Assignee: HYDROLINE OY, Vuorela (FI)

( * ) Notice: Subject to any disclaimer, the term of this patent is extended or adjusted under 35 U.S.C. 154(b) by 45 days.

(21) Appl. No.: 15/534,868

(22) PCT Filed: Nov. 25, 2015

(86) PCT No.: PCT/FI2015/050821
§ 371 (c)(1),
(2) Date: Jun. 9, 2017

(87) PCT Pub. No.: WO2016/092150
PCT Pub. Date: Jun. 16, 2016

(65) Prior Publication Data

US 2017/0350427 A1 Dec. 7, 2017

(30) Foreign Application Priority Data

Dec. 9, 2014 (FI) ..... 20146077

(51) Int. Cl.
*F15B 19/00* (2006.01)
*F15B 15/14* (2006.01)

(52) U.S. Cl.
CPC ..... *F15B 19/005* (2013.01); *F15B 19/007* (2013.01); *F15B 15/14* (2013.01);
(Continued)

(58) Field of Classification Search
CPC ..... F15B 19/005; F15B 19/007; F15B 2211/857; F15B 15/14; F15B 2211/865;
(Continued)

(56) References Cited

U.S. PATENT DOCUMENTS 7,082,758 B2 8/2006 Kageyama et al.
7,908,928 B2 * 3/2011 Vik ..... G01M 5/0041 73/806

(Continued)

FOREIGN PATENT DOCUMENTS

BY 14878 C1 10/2011
CN 101427033 A 5/2009

(Continued)

OTHER PUBLICATIONS

Tuegel, Eric J., et al., "Reengineering Aircraft Structural Life Prediction Using a Digital Twin," 2011, Hindawi Publishing Company, International Journal of Aerospace Engineering, vol. 2011, Article ID 154798, pp. 1-14 (Year: 2011).*

(Continued)

*Primary Examiner* — Leslie J Evanisko
*Assistant Examiner* — Leo T Hinze
(74) *Attorney, Agent, or Firm* — Buchanan Ingersoll & Rooney PC

(57) ABSTRACT

A monitoring device and a method for determining operating health of a pressure medium operated device. The monitoring device is configured for processing input measuring data relating to operation of the pressure medium operated device. An operating condition value is determined in the monitoring device, where after the operating condition value is compared to an input reference data in order to determine current operating health. The reference data is determined by utilizing strength analysis, which is executed for a design model of the associated pressure medium operated device.

20 Claims, 2 Drawing Sheets

(52) U.S. Cl.
CPC ..... *F15B 2211/6313* (2013.01); *F15B 2211/85* (2013.01); *F15B 2211/857* (2013.01); *F15B 2211/865* (2013.01)

(58) Field of Classification Search
CPC ..... F15B 2211/6313; F15B 2211/85; G05B 23/0283
See application file for complete search history.

(56) References Cited

U.S. PATENT DOCUMENTS

| | | | | |
|---|---|---|---|---|
| 7,917,325 | B2 | 3/2011 | Bredau et al. | |
| 9,315,970 | B2 * | 4/2016 | Chitty | E21B 15/04 |
| 9,558,599 | B2 | 1/2017 | Chitty et al. | |
| 10,113,423 | B2 * | 10/2018 | Haisler | E21C 35/04 |
| 2002/0193924 | A1 | 12/2002 | Muller | |
| 2005/0262838 | A1 | 12/2005 | Kageyama et al. | |
| 2008/0163936 | A1 | 7/2008 | Boger et al. | |
| 2009/0019938 | A1 | 1/2009 | Klosinski | |
| 2010/0153026 | A1 | 6/2010 | Bredau et al. | |
| 2012/0161965 | A1 | 6/2012 | Babu et al. | |
| 2013/0179046 | A1 * | 7/2013 | Nassouri | F15B 1/08 701/60 |
| 2014/0236432 | A1 | 8/2014 | Haisler et al. | |
| 2014/0244101 | A1 | 8/2014 | Chitty et al. | |
| 2016/0196699 | A1 | 7/2016 | Chitty et al. | |
| 2017/0350427 | A1 | 12/2017 | Leinonen et al. | |

FOREIGN PATENT DOCUMENTS

| | | | |
|---|---|---|---|
| CN | 102705303 | A | 10/2012 |
| CN | 102748340 | A | 10/2012 |
| CN | 103874807 | A | 6/2014 |
| CN | 104169629 | A | 11/2014 |
| EP | 1722142 | B1 | 7/2008 |
| EP | 2 642 133 | A1 | 9/2013 |
| FI | 128394 | B | 4/2020 |
| JP | 2004068663 | A | 3/2004 |
| RU | 2266440 | C1 | 12/2005 |
| RU | 2296239 | C2 | 3/2007 |
| WO | 2013040633 | A1 | 3/2013 |
| WO | 2016092150 | A1 | 6/2016 |

OTHER PUBLICATIONS

Office Action dated Mar. 27, 2018, by the Chinese Patent Office in corresponding Chinese Patent Application No. 201580075048.1, and a partial English Translation of the Office Action. (9 pages).
International Search Report (PCT/ISA/210) dated Feb. 19, 2016, by the Finnish Patent Office as the International Searching Authority for International Application No. PCT/FI2015/050821.
Written Opinion (PCT/ISA/237) dated Feb. 19, 2016, by the Finnish Patent Office as the International Searching Authority for International Application No. PCT/ FI2015/050821.
English Translation of Office Action and Search Report dated Apr. 4, 2019, by the Russian Patent Office in corresponding Russian Patent Application No. PCT/FI2015/050821. (7 pages).
Office Action dated Aug. 21, 2020, by the Canadian Patent Office in corresponding Canadian Patent Application No. 2,970,421. (8 pages).

* cited by examiner

MONITORING DEVICE AND METHOD FOR DETERMINING OPERATING HEALTH OF PRESSURE MEDIUM OPERATED DEVICE

BACKGROUND OF THE INVENTION

The invention relates to a monitoring device for determining operating health of a pressure medium operated device.

The invention further relates to a method for determining operating health of a pressure medium operated device.

The field of the invention is defined more specifically in the preambles of the independent claims.

Hydraulic systems may be provided with different hydraulic devices, such as hydraulic actuators for causing desired movement such as rotation and linear movement. The hydraulic devices are subjected to wear during their use and they may eventually fail. Further, fail of a component or structure of the device may harm the operation of the device, and may also cause damage to other devices connected to the hydraulic system. Therefore different systems and monitoring devices are developed for determining and indicating operating health of the hydraulic devices. Document US-2009/0019938-A1 discloses a rotary machine provided with a diagnostic system. In order to determine the operating health, monitoring results are compared to results of practical bench tests. However, the known solutions have shown to contain some disadvantages.

BRIEF DESCRIPTION OF THE INVENTION

An object of the invention is to provide a novel and improved monitoring device and method for determining operating health of a pressure medium operated device.

The monitoring device according to the invention is characterized in that the input reference data is computed using strength analysis executed for a design model of the pressure medium operated device.

The method according to the invention is characterized by determining the input reference data by using a strength analysis executed for a design model of the pressure medium operated device.

An idea of the disclosed solution is than an operation condition value is determined for one or more pressure medium operated devices by means of a monitoring device. Operation of the monitored device is measured by means of measuring means and the measuring data is input to the monitoring device in order to further process it. The monitoring device produces one or more operating condition values on the basis of the received measuring data. In order to determine the present operating health of the monitored device, the monitoring device compares the determined operating condition value to a reference data. The reference data is based on design data or model of the monitored pressure medium operated device and is produced by utilizing strength analysis for the design data.

An advantage is that the disclosed solution provides improvements to health monitoring of pressure medium operated devices. The reference data may be produced easy and fast since it is based on design data and strength analysis. The reference data may be produced already during design work and needs no extensive separate motions. The design data is available and may be analyzed by means of a suitable computer program, for example. Furthermore, modifications to the design data may be easily taken into consideration. Thanks to the disclosed solution practical physical testing of the pressure medium operated device is not necessarily required for determining the reference data.

According to an embodiment, the monitoring device is provided with at least one data set comprising reference data based on fatigue analysis calculation. Thus, the monitoring device is configured to compare the processed current operating condition value with the reference data of the fatigue analysis calculation.

According to an embodiment, the monitoring device comprises at least one processor for executing at least one monitoring program in the processor. The processor may then process the received measuring data and perform the comparison with the input reference data.

According to an embodiment, the monitoring device comprises means for filtering the received measuring data in order to recognize measuring values which are significant regarding the loadings and the operating health, and on the other hand, to detect measuring results, which are of less importance regarding the operating health. The monitoring device may comprise a control unit provided with at least one filtering program, the execution of which program is configured to analyze the measuring data. The filtering program may be arranged to classify the received measuring values and results. Thus, the filtering step may provide two or more measuring data classes having different influence and importance to the operating health.

According to an embodiment, the monitoring device comprises filtering means for filtering the received measuring data according to predetermined principles. Thus, the monitoring device may be configured to gather only relevant measuring data and process it. The filtered data may comprise data of significant pressure pulses directed to the monitored device and strain history of the monitored device, whereby the filtered data may only comprise data which is significant regarding fatigue. The filtering principles may define the monitored features and limit values and ranges for the same.

According to an embodiment, the reference data is determined by means of Finite Element Analysis, known as FE-analysis.

According to an embodiment, the reference data input to the monitoring device comprises a reference value or a set reference values. The reference value may thus comprise one or more numerical values. The reference value may determine maximum allowed numerical value for a determined physical property.

According to an embodiment, the reference value may comprise maximum amount of events when pressure acting in a pressure space of the pressure medium operated device exceeds a predetermined pressure limit. Such high pressure situations may have significant influence to wearing and mechanical loading of the pressure medium operated device.

According to an embodiment, the input reference value may comprises maximum total amount of operating cycles defined for the associated pressure medium operated device or a critical single component of the device. Alternatively, the reference value may comprise maximum number of significant operating cycles comprising loadings that exceed a predetermined load and are considered to be harmful for the structure of the device or which may cause extensive wearing. When counting the operating cycles of the monitored device, filtering may be executed for the measuring results for recognizing the significant operating cycles. Thus, by means of the filtering, operating cycles having normal or minor effect on the operating health may be ignored.

According to an embodiment, the reference value may comprise a maximum mechanical loading value. Alternatively, the reference value may comprise a maximum cumulative value for mechanical loading. The mechanical loading values may be determined for a desired component or structural part of the pressure medium operated device. The system may monitor condition of a critical component, for example.

According to an embodiment, the reference value may comprise a maximum amount of movement of the pressure medium operated device. Thus, allowed total travel of a movable member of the device may be determined. The design data may comprise information on sealed machine elements and their seals, whereby the strength analysis may determine maximum total travel for the seals, for example.

According to an embodiment, the reference data input to the monitoring device comprises a reference model, which may be a mathematical model relating to fatigue determination. The reference model may comprise an algorithm or computer program product and it may be executed in a processor of the monitoring device. The reference model may also be adaptive, whereby it may take into account changing operating conditions and usage. The reference model may be deduced from a model produced by means of a strength analysis tool or software.

According to an embodiment, the device is configured to determine the operating health of the monitored pressure medium operated device by monitoring the operating life of one single critical component of the monitored device. The selected critical component may be determined beforehand on the basis of the design work and strength analysis. Thus, the reference data input to the monitoring device may be determined by fatigue analysis and may comprise a fatigue limit for the critical component, for example. Thanks to this embodiment, the monitoring may be focused to components, which may be critical regarding safety or operation of the monitored pressure medium operated device. The selected monitored object may also be a component known to be vulnerable.

According to an embodiment, the device being monitored is a hydraulic cylinder arranged to produce linear movement.

According to an embodiment, the device being monitored is a hydraulic motor arranged to produce rotation movement.

According to an embodiment, the device being monitored is a hydraulic pump arranged to generate hydraulic power to a hydraulic system.

According to an embodiment, the device being monitored is a hydraulic pressure accumulator arranged to store pressure energy.

According to an embodiment, the pressure medium operated device being monitored is a pneumatic device, such as a pneumatic cylinder, motor, pump or pressure accumulator. Thus, the solution disclosed in this patent application may also be utilized for monitoring devices which are operated by means of pressurized gas or any other pressurized fluid.

According to an embodiment, the monitoring device is located at the pressure medium operated device being monitored. Thus, the monitoring device may be integrated to be part of the structure of the pressure medium operated device. Alternatively, the monitoring device may comprise a body and fastening elements allowing mounting and dismounting the monitoring device to the monitored hydraulic or pneumatic device. Further, the monitoring device may be a module comprising at least a control unit, at least one measuring device and a data connection unit integrated into one unit. The monitoring device may also be provided with fast coupling means, whereby the monitoring device having the module configuration may be fastened to a hydraulic or pneumatic device in one unit and correspondingly dismounted therefrom. The data connection unit may comprise wired or wireless data communication means allowing data communication between the monitoring device and at least one external computer, server or electrical terminal device.

According to an embodiment, the monitoring device is located external to the pressure medium operated device being monitored. Then, measuring data may be transmitted from one or more measuring devices to the monitoring device via wireless or wired data communication means. The measuring data may be sent to the monitoring device periodically, continuously or according to a request. The monitoring device may be a mobile electrical terminal device such as a laptop, tablet computer, palm-top computer, smart phone or special mobile computer designed for service personnel. Alternatively, the monitoring device may be a personal computer, server, a set of several servers or computers, or a net of several computers, such as a cloud service. The monitoring device may comprise a display device or indicating device for presenting information for a user.

According to an embodiment, the reference data determined on the basis of the design model is verified before inputting it to the monitoring device. Thus, the computed reference data is compared to results of experimental laboratory tests made in a test stand. Thanks to this embodiment, accuracy of the reference data may be further improved since it is possible to adjust the reference data on the basis of results of the comparison.

According to an embodiment, the monitoring device comprises at least one health indicating device. Thus, the monitoring device stay comprise one or more display devices, visual indicators or any other suitable indicating devices for informing the determined operating health for the operator or maintenance personnel.

According to an embodiment, the monitoring device comprises at least one health data base or memory device allowing storing of data relating the determined operating health, operating condition values and measuring results. The scored data may be analyzed whenever needed and desired reports and documents may be produced.

According to an embodiment, the monitoring device is configured to recognize operating style of the operator of a machine comprising the monitored pressure medium operated device. The monitoring device is configured to analyze the measuring data and based on that decide the operating style of the operator. The monitoring device may comprise predetermined characterizing features for different operating styles in order to classify the monitored use situation. Thanks to this embodiment, operator related differences in the operating style may be taken into account when determining the operating health.

According to an embodiment, the monitoring device is configured to recognize operating style of the operator. The monitoring device may determine probability of failure on the basis of the recognized operating style. The monitoring device may also estimate instant of time when the monitored pressure medium operated device will failure if the same operating style is continued. The estimation may be based on probability calculation. When the monitoring device detects a personal operating style of the operator, the device may perform a warning signal or message for the operator to inform the operator that the currently used operating style is harmful and will lead to failure after an estimated period of time. Thanks to this embodiment, the operator is provided with a feedback, which motivates the operator to change the current operating style. The embodiment may also be utilized in training of operators.

According to an embodiment, the monitoring device is provided with a predetermined or estimated operating life determined for the monitored pressure medium operated device. The set operating life may be based on calculation and analysis wherein the monitored device is used according to a predetermined range of operating parameters. Thus, in order to achieve the desired or optimal operating life, the pressure operated device needs to be used so that situations causing additional loadings and fatigue are avoided. The set operating life may be a kind of ideal operating life and may be determined by means of strength analysis. However, operating styles of the operators vary, whereby the monitored device may be subjected to loadings caused by undesired or unexpected way of use. The monitoring device may record the situations causing additional loadings and fatigue, may inform the operator of the detected harmful way of use, and may determine an expected operating life. The monitoring device may indicate on the basis of gathered data the expected operating life relative to the set desired operating life, which is based on optimal way of use of the monitored device. Thanks to this embodiment, the operator is provided with a feedback, which motivates the operator to change the current operating style, to avoid situations causing extra leadings, and also to use defined operating parameters.

According to an embodiment, the monitoring device is provided with a predetermined or estimated operating life determined for the monitored pressure medium operated device. The monitoring device may be arranged to monitor the pressure medium device for a limited period of time and may according to the gathered monitoring data estimate what will be an expected operating life of the monitored device. The disclosed solution may be implemented in situations where a new apparatus is composed and no previous loading history of the pressure medium operated device is available. Further, when the apparatus provided with the pressure medium device is used in a new different use or application, a short-term testing period in the intended use position or application may be utilized to produce an estimate of the expected operating life. The short-term monitoring or testing period may be sufficient to indicate feasibility of the monitored device for the intended use and application. Possibly, no further measuring and monitoring during the operating life are needed. Thanks to this embodiment, feasibility of the pressure medium device for the intended purpose may be verified at an early phase of the operation. When noticed that the tested device will fail the set target value, it may be substituted by another device.

The above-disclosed embodiments can be combined to form suitable solutions provided with necessary features disclosed.

BRIEF DESCRIPTION OF THE FIGURES

Some embodiments are described in more detail in the accompanying drawings, in which.

For the sake of clarity, the figures show some embodiments of the disclosed solution in a simplified manner. In the figures, like reference numerals identify like elements.

DETAILED DESCRIPTION OF SOME EMBODIMENTS

Figures 1, 2:
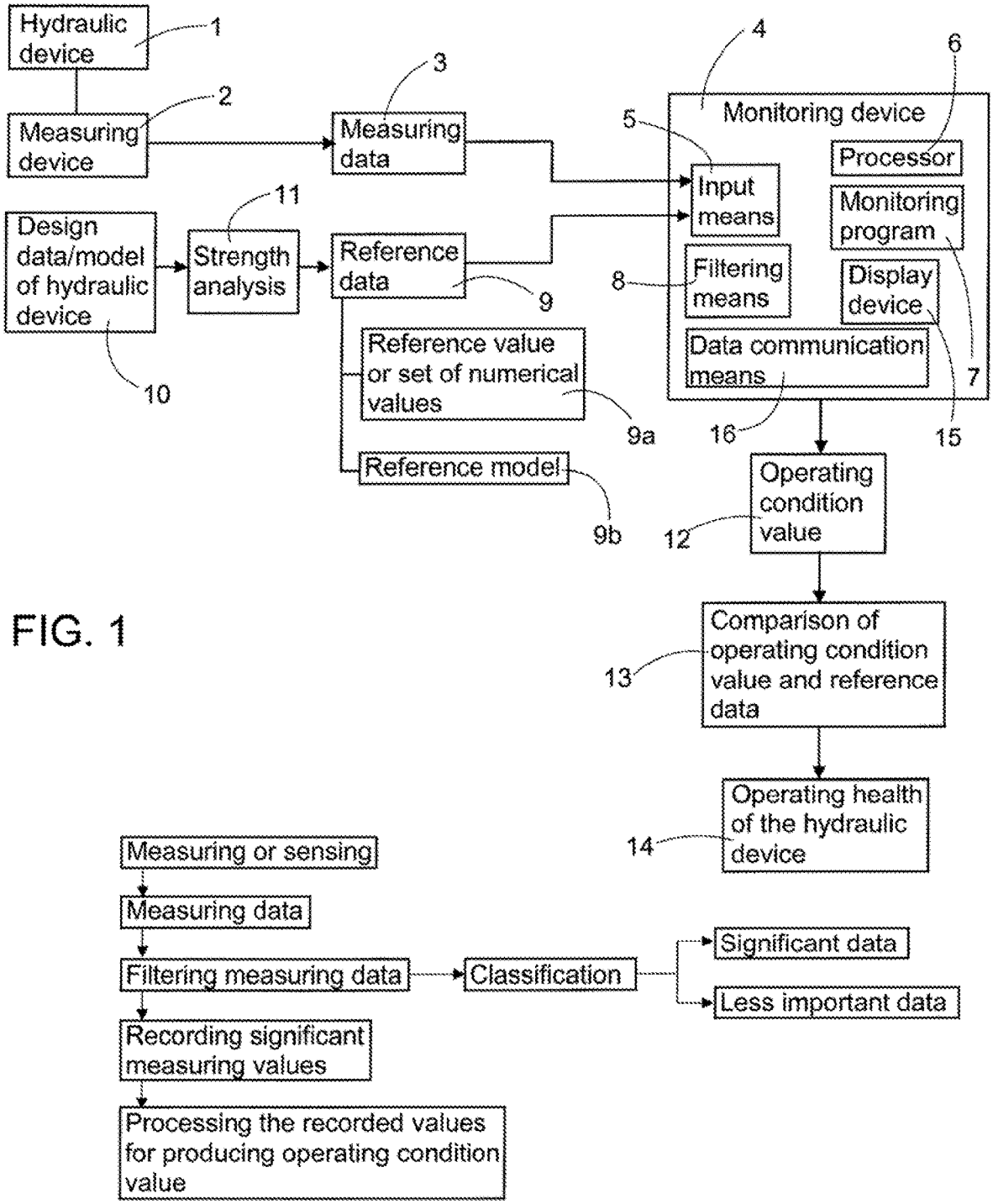
FIG. 1 is a schematic diagram of a monitoring system.
FIG. 2 is a schematic diagram of processing measuring data.

FIG. 1 shows a system for monitoring operating health of a hydraulic device 1, which may be a hydraulic actuator such as a hydraulic cylinder or hydraulic motor. Further, the hydraulic device may be a hydraulic pump or hydraulic accumulator, for example. The hydraulic device 1 is provided with one or more measuring devices 2 for measuring one or more physical features during the use of the hydraulic device 1. The gathered and produced measuring data 3 is input to a monitoring device 4 by means of input means 5. The monitoring device 4 may be located in connection with the monitored hydraulic device 1, or it may be located external to the hydraulic device 1. The monitoring device 4 may comprise one or more processors 6 for executing one or more monitoring programs 7. The monitoring device 4 may also comprise a filtering program or other type of filtering means 8 in order to determine significance of the input measuring data 3. Alternatively, the measuring device 2 may be provided with suitable filtering means, whereby the measuring data 3, which is input to the monitoring device 4, is already filtered and is classified to be relevant.

Further, at least one reference data 9 is also input to the monitoring device 2 by means of input means 5. The reference data 9 may comprise one or more reference values 9*a* or a set of several numerical values, or alternatively, or in addition to, one or more reference model 9*b*, which may be a mathematical model or algorithm. The reference data 9 may be determined already during the design process of the monitored hydraulic device 1. In order to determine the reference data 9 only design data or model 10 of the hydraulic device 1 is needed. The reference data 9 may be generated by executing strength analysis 11 for the design data. Typically a strength analysis program and computer are utilized.

The monitoring device 4 may analyse the input measuring data 3 and may process an operating condition value 12, which indicates current situation of the hydraulic device 1. The operating condition value 12 may indicate cumulated loading, wearing or operating cycles, for example. In order to determine operating health of the hydraulic device 1 the monitoring device 2 compares 13 the determined current operating condition value 12 with the input reference data 9 and indicates the current operating health 14 of the hydraulic device 1. The produced operating health 14 may indicate remaining operating cycles or mechanical loadings, or it may indicate degree of wear, for example. The monitoring device 4 may also comprise a display device 15 or other means for indicating the operating health 14 for service personnel. Alternatively, or in addition to the display device 15 the monitoring device 4 may comprise a data communication device 16 for allowing a data connection between the monitoring device 4 and at least one external device. Thus, the operating health 14 may be indicated visually, or it may be transmitted to a portable terminal device, for example.

FIG. 2 illustrates that the measuring data may be filtered so that only significant measuring results are taken into account when determining operating health of a hydraulic device.

Figure 3:
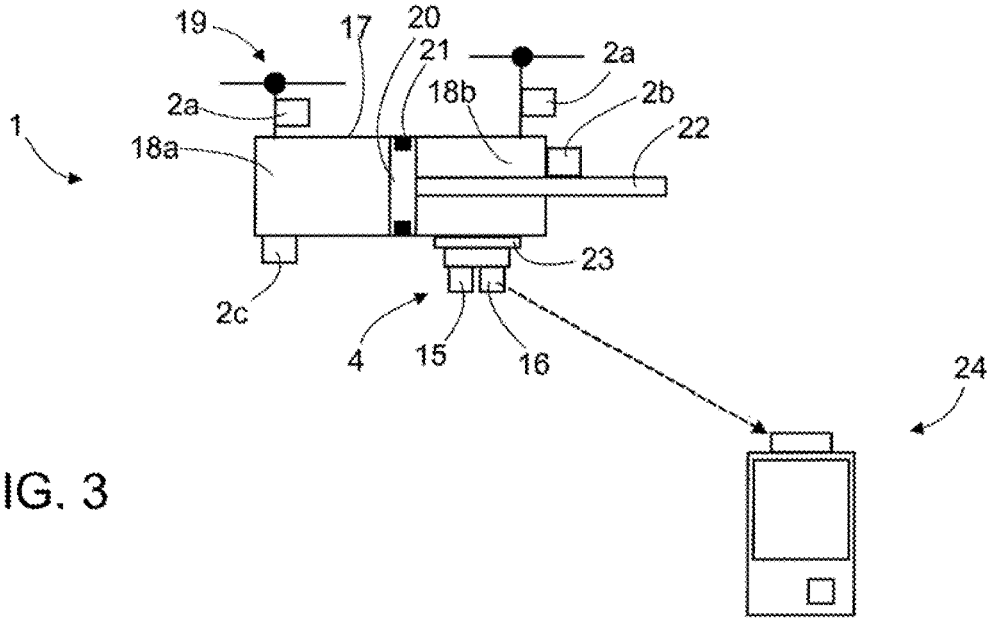
FIG. 3 is schematic side view of a hydraulic device provided with a monitoring device.

As it is shown in FIG. 3, the hydraulic device 1 may be a hydraulic cylinder. The hydraulic cylinder comprises a frame 17 inside which is at least one pressure space 18*a*, 18*b*, which is connected by means of feed means to a hydraulic system 19. The hydraulic cylinder further comprise a piston 20 arranged inside a cylinder space of the frame 17 and is sealed by means of seals 21 against an inner surface of the cylinder space. The piston 20 is arranged to move linearly according to pressure difference between the pressure spaces 18*a*, 18*b*. Generated linear movement may be transmitted by means of a piston rod 22 to a desired use.

The hydraulic cylinder may be provided with one or more measuring devices. Pressure sensors 2*a* or transducers may be arranged in connection with pressure ducts leading to the pressure spaces 18*a*, 18*b*, or pressure sensing devices may be arranged to measure pressure directly from the pressure spaces 18*a*, 18*b*. Measuring data of the pressure sensors 2*a* may be used to determine pressures of the pressure spaces and caused mechanical loadings to the construction. The hydraulic cylinder may also comprise one or more position measuring devices 2*b*, whereby number of operating cycles of the hydraulic cylinder may be detected as well as amount of movement of the piston 20 and the seals 21. The operating cycles may also be recognized by analysing the pressure data and pressure variations. Mechanical loading of the hydraulic cylinder may also be measured by means of one or more load sensors 2*c* such as strain gauges, piezoelectric sensors or any other type of sensor allowing measurements of mechanical loadings. In addition to the mentioned sensors 2*a*-2*c* other type of measuring devices may be used to measure physical features of the hydraulic cylinder. The measuring data may be transmitted from the sensors 2*a*-2*c* to a monitoring device 4 mounted to the hydraulic cylinder. Alternatively, one or more sensors may be integrated to the monitoring device whereby they may form a module.

The monitoring device 4 may comprise mounting means 23 for fastening the monitoring device 4 on an outer surface of the frame 17 of the hydraulic cylinder. The mounting means 23 may comprise fast coupling means allowing easy mounting and dismounting of the monitoring device 4. The monitoring device may comprise a body consisting of two halves or several body parts, which may be placed on an outer surface of a hydraulic cylinder and which halves or body parts are connectable to each other by fastening means, such as screws. Alternatively, the mounting means 23 may comprise a fastening band, which may be placed around the frame 17 of the hydraulic cylinder. The mounting means 23 may be designed so that mounting to existing hydraulic devices is easy and requires no modifications to their basic construction. The monitoring device 4 may be positioned so that an indicating device 15 is visible. The monitoring device 4 may transmit the monitoring data and results by means of a data communication unit 16 to an electrical terminal device 24 or to a data network comprising one or more servers or computers.

In FIG. 3 the measuring data may be transmitted from the measuring devices 2*a*-2*c* through wired or wireless data transmission to the monitoring device 4. Further, the data communication between the monitoring device 4 and the external devices 24 may also be wired or wireless. The wireless data communication means may utilize Bluetooth, radio signals, WiFi or RFID, for example.

Figure 4:
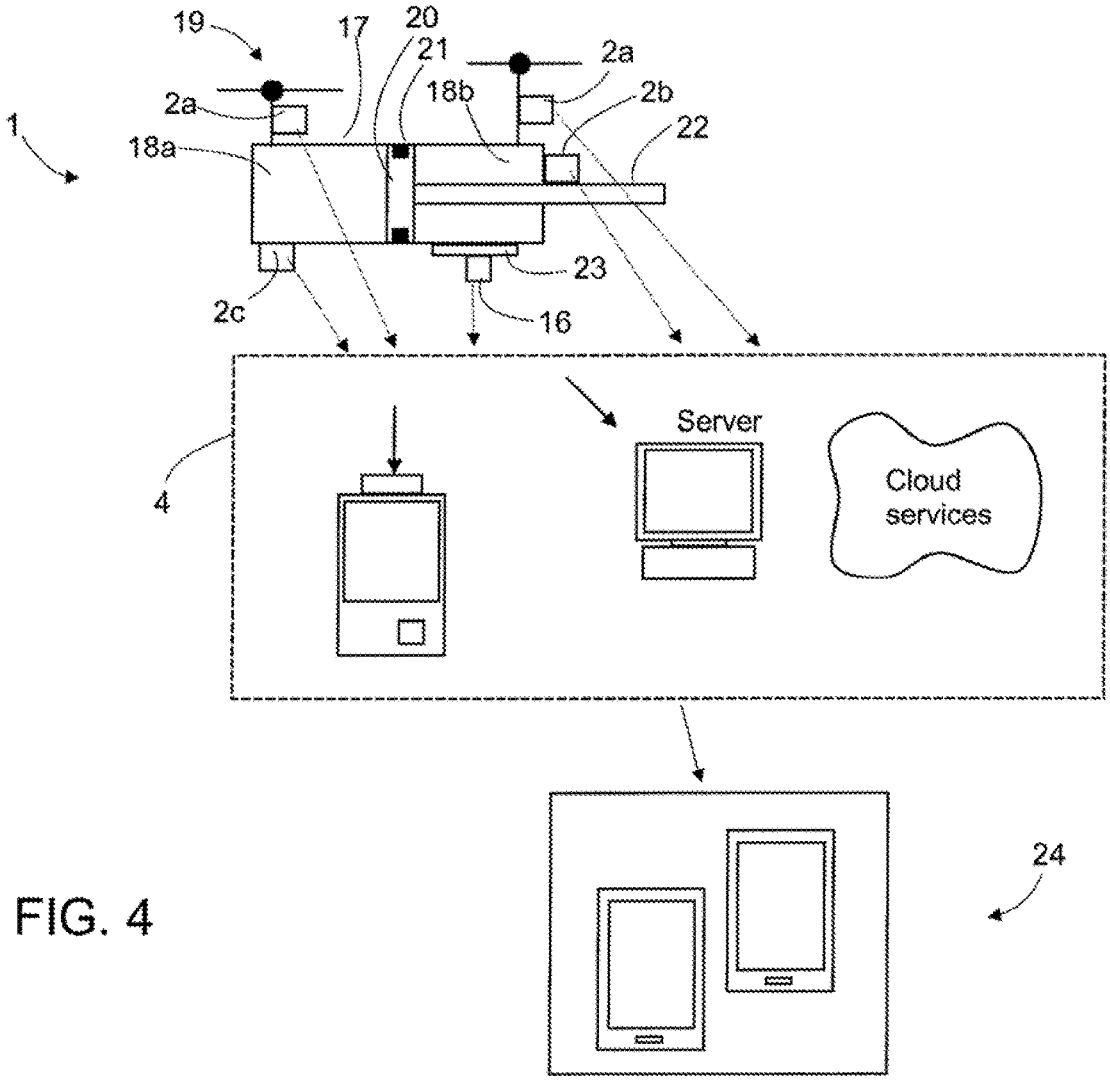
FIG. 4 is a schematic side view of another monitoring system, wherein a hydraulic device is provided with measuring devices and is being monitored by means of an external monitoring device.

FIG. 4 discloses another monitoring device 4, which is located external to a hydraulic device 1 feeing monitored. The hydraulic device 1 may correspond to the hydraulic cylinder or FIG. 3 and may be provided with one or more several measuring devices 2*a*-2*c*. Measuring data of the measuring devices 2*a*-2*c* may be transmitted to a data communication device 16, which may transmit the data to the external monitoring device 4. Alternatively, the measuring devices 2*a*-2*c* may be provided with data transmission means of their own, whereby measuring data may be transmitted directly from the measuring devices 2*a*-2*c* to the monitoring device 4. The data communication may be wired or wireless. The wireless data communication means may utilize Bluetooth, radio signals, WiFi or RFID, for example. Transmission of the measuring data may be done periodically, continuously or according to a separate request.

In FIG. 4 the monitoring device 4 may be a mobile electrical terminal device such as a laptop, tablet computer, smart phone, for example. Alternatively the monitoring device is a server or set or several servers or computers. The monitoring device may also be based on a cloud service. The monitoring device 4 may transmit the monitoring data and results to an electrical terminal device 24 or to a data network comprising one or more servers or computers.

Alternatively, the monitored device disclosed above may be a device operable by means of pressurized gas or other suitable fluid.

The disclosed monitoring and the determined operating health may be utilized at least in the following manner:

a) to record load history of a monitored device,
b) to determine or estimate number of load cycles to failure of a monitored component,
c) to define a preventive maintenance schedule for the device being monitored,
d) to provide an estimation of remaining operating life of the pressure medium operated actuator or a specific monitored component i.e. to estimate lifespan,
e) to indicate exceed of the predetermined fatigue limit,
f) to identify deterioration of a specific component, and
g) to predict time to service and the extend of service required.

The drawings and the related description are only intended to illustrate the idea of the invention. In its details, the invention may vary within the scope of the claims.

What is claimed is:

1. A monitoring device for determining operating health of a pressure medium operated device, which includes a frame having plural pressure spaces and a cylinder space that includes a piston that moves linearly based on a pressure difference between the pressure spaces, the monitoring device comprising:

one or more first sensors arranged to measure pressure from the plurality of pressure spaces;

one or more second sensors arranged in the cylinder space to measure at least an amount of movement of the piston;

one or more third sensors arranged in the cylinder space to measure a mechanical load of the pressure medium operated device;

mounting means for fastening the monitoring device to the frame of the pressure medium operated device;

at least one reference data input to the monitoring device, the reference data including one or more reference pressures of the plural pressure spaces, a reference positon of the piston, and a reference mechanical load; and wherein:

the monitoring device having one or more processors configured to:

store, in a memory device, a plurality of sets of predetermined features, each set of predetermined features identifying an operating style of an operator;

receive measuring data from the one or more first, second, and third sensors, the measuring data including at least pressure measurement, piston movement measurements, and mechanical load measurements, the measuring data relates to at least one physical feature of the pressure medium operated device during operation of the pressure medium operated device;

filter the received measuring data according to one of a plurality of predetermined control strategies including failure, fatigue, and service schedule, which are indicative of the operating health of the pressure medium operated device, the pressure, piston movement, and mechanical load measuring data being filtered into at least two categories having different importance for the operating health of the pressure medium operated device according to the one predetermined control strategy;

process the filtered measuring data for determining at least one operating condition value of a current situation, wherein only one of the at least two categories of the filtered measuring data is used for determining the at least one operating condition value;

analyze the filtered measuring data to determine the operating style of a current operator of the pressure medium operated device by identifying one of the sets of predetermined features associated with the determined operating style in the filtered measuring data;

classify a use of the pressure medium operated device being monitored based on the one set of predetermined features identified in the filtered measuring data;

calculate input reference data using at least a fatigue analysis executed for a design model of the pressure medium operated device;

compare the operating condition value with the calculated input reference data in order to determine an operating health of the pressure medium operated device; and generate a warning signal or message including an estimated period of time to failure based on the operating health and the classified use of the pressure medium operated device.

2. The device as claimed in claim 1, wherein the monitoring device comprises:

at least one processor for executing at least one monitoring program in the processor and is configured to process the received measuring data to obtain the operating condition value and perform the comparison with the calculated input reference data.

3. The device as claimed in claim 2, wherein the one or more processors is configured to determine the reference data by FE-analysis (Finite Element Analysis).

4. The device as claimed in claim 3, wherein the one or more processors of the at least one monitoring device is configured to determine the operating health of the monitored pressure medium operated device by monitoring an operating life of at least one single component of the monitored pressure medium operated device.

5. The device as claimed in claim 4, wherein the one or more processors determines at least one fatigue limit by performing the fatigue analysis.

6. The device as claimed in claim 5, wherein the input reference data includes a maximum total amount of operating cycles defined for an associated pressure medium operated device or a critical single component of the pressure medium operated device.

7. The device as claimed in claim 2, wherein the pressure medium operated device being monitored is a hydraulic cylinder.

8. The device as claimed in claim 1, wherein the processor is configured to determine the reference data by FE-analysis (Finite Element Analysis).

9. The device as claimed in claim 1, wherein the monitoring device is configured to determine the operating health of the monitored pressure medium operated device based on an operating life of at least one single-component of the monitored pressure medium operated device.

10. The device as claimed in claim 1, wherein the input reference data is determined by fatigue analysis and includes at least one fatigue limit.

11. The device as claimed in claim 1, wherein the at least one reference data input includes a maximum total amount of operating cycles defined for an associated pressure medium operated or a single component of the pressure medium operated device.

12. The device as claimed in claim 1, wherein the pressure medium operated device being monitored is a hydraulic cylinder.

13. The device as claimed in claim 1, wherein the monitoring device is located at the pressure medium operated device being monitored.

14. The device as claimed in claim 1, wherein the monitoring device is located external to the pressure medium operated device being monitored.

15. The device as claimed in claim 1, wherein the one or more second sensors is further arranged in the cylinder space to measure at least a number of operation cycles of the pressure medium operated device.

16. The device as claimed in claim 1, wherein the one or more second sensors is further arranged in the cylinder space to measure movement in seals of the cylinder space.

17. A method for determining operating health of a pressure medium operated device, which includes a frame having plural pressure spaces and a cylinder space that includes a piston that moves linearly based on a pressure difference between the pressure spaces, the monitoring device being mounted to the frame of the pressure medium operated device, the method comprising:

measuring, by one or more first sensors arranged in proximity to the plurality of pressure spaces, pressure in at least one of the plurality of pressure spaces;

measuring, by one or more second sensors arranged in the cylinder space, at least an amount of movement of the piston;

measuring, by one or more third sensors arranged in the cylinder space, a mechanical load of the pressure medium operated device;

storing, in a memory device, a plurality of sets of predetermined features, each set of predetermined features identifying an operating style of an operator;

receiving, by one or more processors of the at least one monitoring device, measuring data from the one or more first, second, and third sensors, the measuring data including at least pressure measurement, piston movement measurements, and mechanical load measurements, the measuring data relates to at least one physical feature of the pressure medium operated device during operation of the pressure medium operated device;

filtering, via the one or more processors of the at least one monitoring device, the received measuring data according to a predetermined control strategy, including failure, fatigue, and service schedule, which are indicative of the operating health of the pressure medium operated device, the pressure, piston movement, and mechanical load measuring data being filtered into at least two categories having different importance for the operating health of the pressure medium operating device, and the filtered measuring data identifying one or more operating cycles according to an effect on importance for the operating health of the pressure medium operated device according to the one predetermined control strategy;

determining, via the one or more processors of the at least one monitoring device, at least one operating condition value based on the filtered measuring data, wherein only one of the at least two categories of the filtered measuring data is used for determining the at least one operating condition value;

inputting reference data to the one or more processors of the at least one monitoring device;

analyzing, via the one or more processors of the at least one monitoring device, the filtered measuring data to determine the operating style of a current operator of the pressure medium operated device during the operation being monitored by identifying one of the sets of predetermined features associated with the determined operating style in the filtered measuring data;

classifying, via the one or more processors of the at least one monitoring device, a use of the pressure medium operated device being monitored based on the one set of predetermined features associated with the determined operating style identified in the filtered measuring data;

calculating, via the one or more processors of the at least one monitoring device, input reference data using at least a fatigue analysis executed for a design model of the pressure medium operated device;

comparing, via the one or more processors of the monitoring device, the operating condition value with the calculated input reference data in order to determine the operating health of the pressure medium operated device; and generating, via the one or more processors of the monitoring device, a warning signal or message including an estimated period of time to failure based on the operating health and the classified use of the pressure medium operated device.

18. The method according to claim 17, comprising comparing the calculated input reference data computed on the basis of the design model, before inputting to the monitoring device, to results of experimental laboratory tests made in a test stand; and adjusting the calculated reference data based on the comparison.

19. The method as claimed in claim 17, further comprising:

measuring at least a number of operation cycles of the pressure medium operated device by the one or more second sensors.

20. The method as claimed in claim 17, further comprising:

measuring movement in seals of the cylinder space by the one or more second sensors.

* * * * *